United States Patent [19]

Hill

[11] 4,052,759

[45] Oct. 11, 1977

[54] FLOOR-MOUNTED ANCHOR UNIT FOR TOILETS

[76] Inventor: Lloyd W. Hill, 2471 E. Gerard Ave., Merced, Calif. 95340

[21] Appl. No.: 625,070

[22] Filed: Oct. 23, 1975

[51] Int. Cl.[2] ..... E03D 11/00; F16L 51/02; F16L 55/00; F16L 11/12

[52] U.S. Cl. ..... 4/252 R; 285/56; 285/58; 285/57; 285/59; 4/170

[58] Field of Search ..... 4/68, 252 R, 170; 285/56–60

[56] References Cited

U.S. PATENT DOCUMENTS

| | | | |
|---|---|---|---|
| 1,041,905 | 10/1912 | Tong | 4/252 R |
| 2,837,750 | 6/1958 | Robinson | 4/252 R |
| 3,540,064 | 11/1970 | Studer | 4/252 R |
| 3,579,670 | 5/1971 | Frank | 4/252 R |

*Primary Examiner*—Henry K. Artis

*Attorney, Agent, or Firm*—Roger B. Webster

[57] ABSTRACT

A floor-mounted anchor unit for toilets comprising---in association with an upstanding sewer pipe riser set before placement of the floor---a horizontal annular toilet attachment flange on the floor adjacent and in register with such riser, a horizontal annular sub-flange surrounding the riser in spaced relation below the toilet attachment flange and engaged beneath a portion of the floor, and a plurality of vertical, circumferentially spaced screws connected in holding relation between said flanges radially outwardly of the riser; characterized by the toilet attachment flange being initially detached, and means including said screws temporarily assembled with the riser and supporting the sub-flange in position on said riser preparatory to placement of the floor thereabout and over the sub-flange, said means being removable at least in part and with the screws to then permit said connection of said screws between the toilet attachment flange and the sub-flange.

2 Claims, 6 Drawing Figures

FIG-1
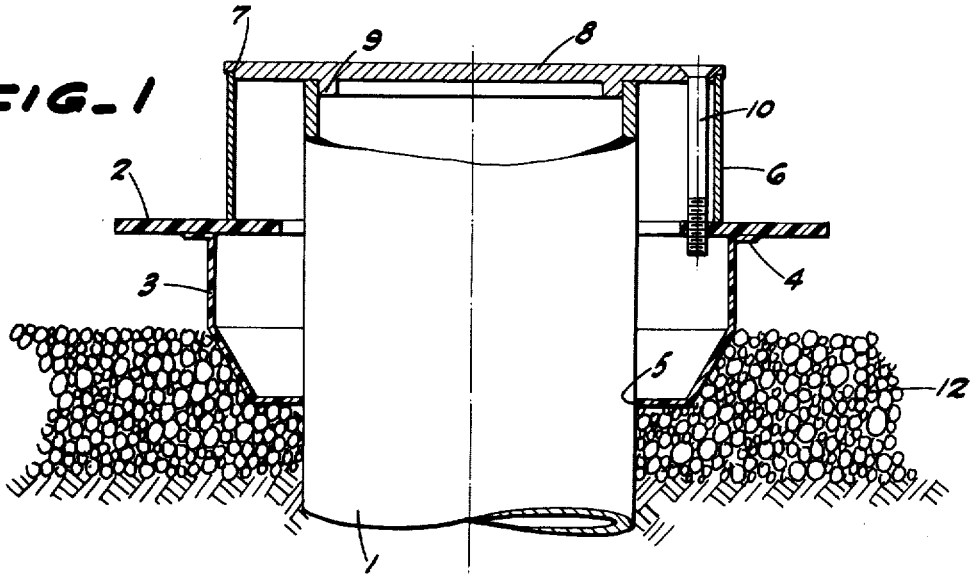
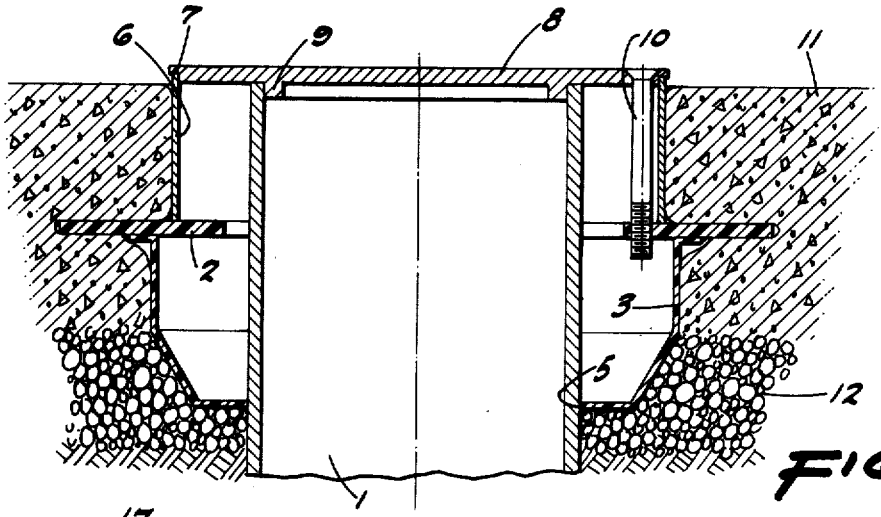
FIG-2
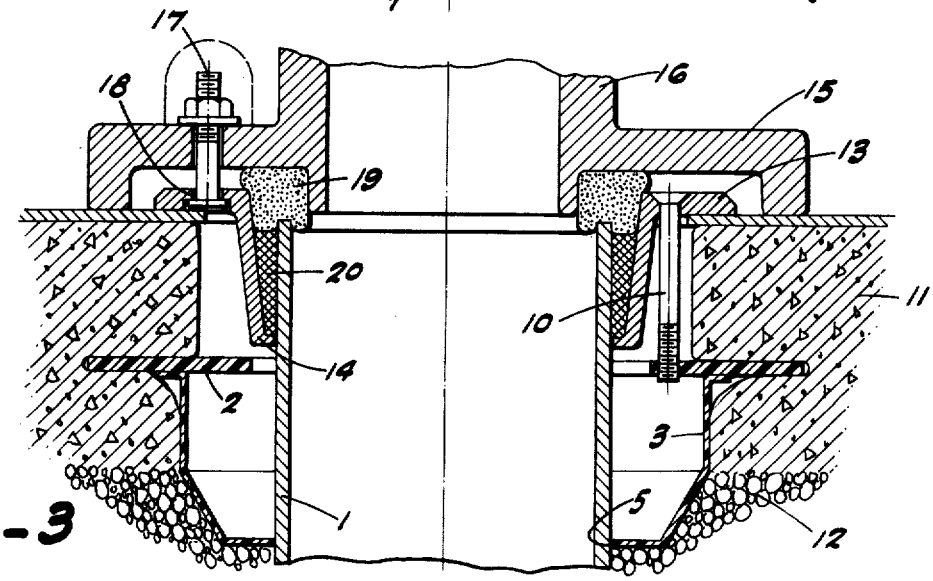
FIG-3

FIG. 4
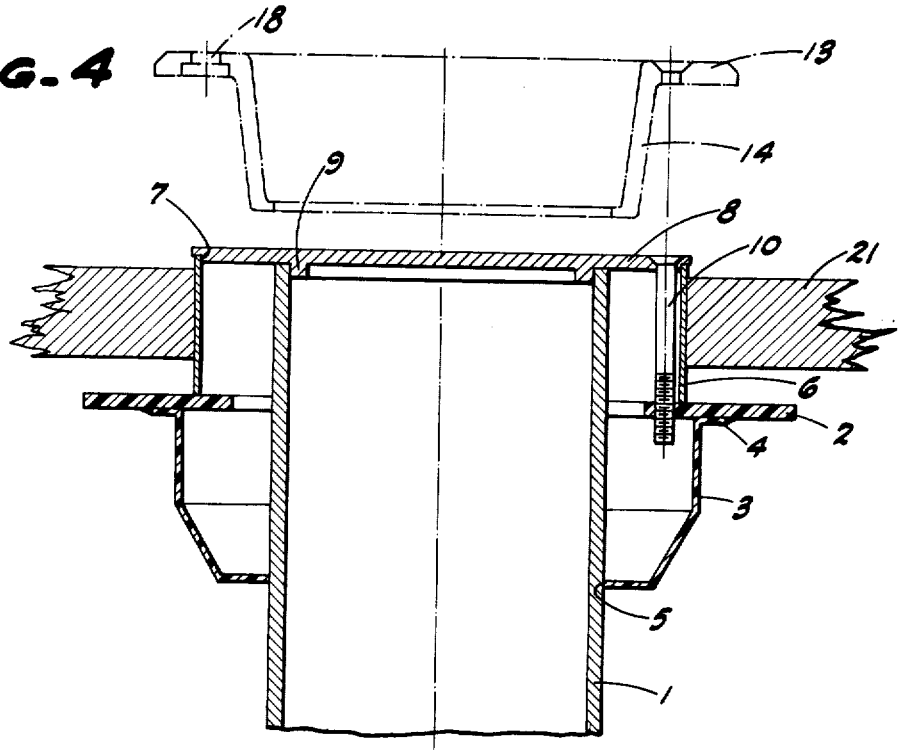
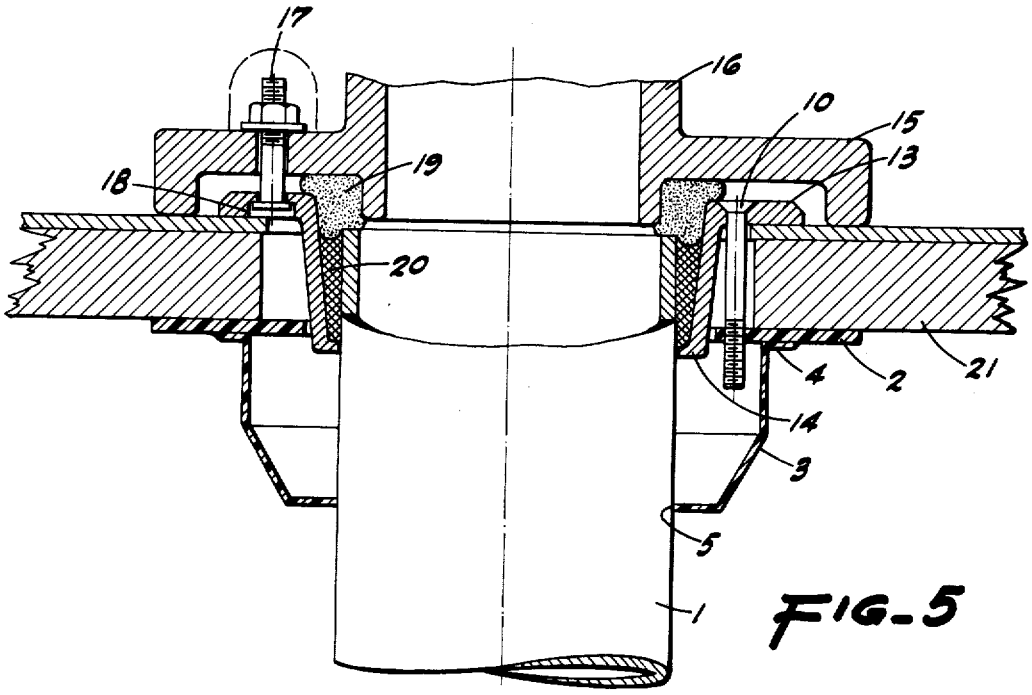
FIG. 5

FLOOR-MOUNTED ANCHOR UNIT FOR TOILETS

BACKGROUND OF THE INVENTION

With the common type of toilet attachment or floor flange, it is merely secured to the floor by screws which have no holding engagement other than with the floor material; the result being that such screws frequently loosen and the toilet becomes wobbly relative to the floor. The present invention was conceived in a successful effort to solve such problem.

SUMMARY OF THE INVENTION

The present invention provides, as an important object, a floor-mounted anchor unit for toilets comprising—in association with an upstanding sewer pipe riser set before placement of the floor—a horizontal anular toilet attachment flange on the floor adjacent and in register with such riser, a horizontal annular sub-flange surrounding the riser in spaced relation below the toilet attachment flange and engaged beneath a portion of the floor, and a plurality of vertical, circumferentially spaced screws connected in holding relation between said flanges radially outwardly of the riser; characterized by the toilet attachment flage being initially detached, and means including said screws temporarily assembled with the riser and supporting the sub-flange in position on said riser preparatory to placement of the floor thereabout and over the sub-flange, said means being removable at least in part and with the screws to then permit said connection of said screws between the toilet attachment flange and the sub-flange.

The present invention provides, as another important object, a floor-mounted anchor unit for toilets, as above, characterized by the sub-flange supporting means including a cylindrical sleeve seated on the upstanding from the sub-flange in concentric surrounding relation to the sewer pipe riser radially outwardly of the screws, and a removable top plate on the upstanding sleeve closing the upper end of the riser; the top plate extending radially outwardly beyond the riser, and the screws, in said temporary assembly, being connected between the extended portion of the top plate and the sub-flange.

The present invention provides, as still another important object, a floor-mounted anchor unit, as above, which includes a cup-like shroud fixed on and depending from the sub-flange in frictional surrounding relation to the riser for the purpose of initially holding said sub-flange in position on said riser, and also shielding the portions of the screws which extend below such sub-flange.

The present invention provides, as a further object, a floor-mounted anchor unit for toilets which is designed for ease and economy of manufacture, and ready installation.

The present invention provides, as a still further object, a practical, reliable, and durable floor-mounted anchor unit for toilets, and one which is exceedingly effective for the purpose for which it is designed.

BRIEF DESCRIPTION OF THE DRAWINGS

FIG. 1 is a sectional elevation of the anchor unit (excluding the toilet attachment flange) showing the sub-flange as initially supported on the sewer pipe riser preparatory to placement of the floor.

FIG. 2 is a similar view, but shows the floor as placed over the sub-flange; the floor being poured concrete.

FIG. 3 is a sectional elevation corresponding generally to FIG. 2, but shows the toilet attachment flange as connected to the sub-flange by the screws and thus bound to the concrete floor; this after removal of certain parts of the initial, sub-flange supporting arrangement. A toilet base is shown as secured to said attachment flange.

FIG. 4 is a view similar to FIG. 2, but shows a wood floor as placed over the sub-flange; the initially detached toilet attachment flange being shown in phantom lines, and—for illustration—in an elevated position.

FIG. 5 corresponds generally to FIG. 4, but shows the toilet attachment flange as bound to the floor, and with a toilet base secured to said attachment flange.

DESCRIPTION OF THE PREFERRED EMBODIMENT

Figure 6:
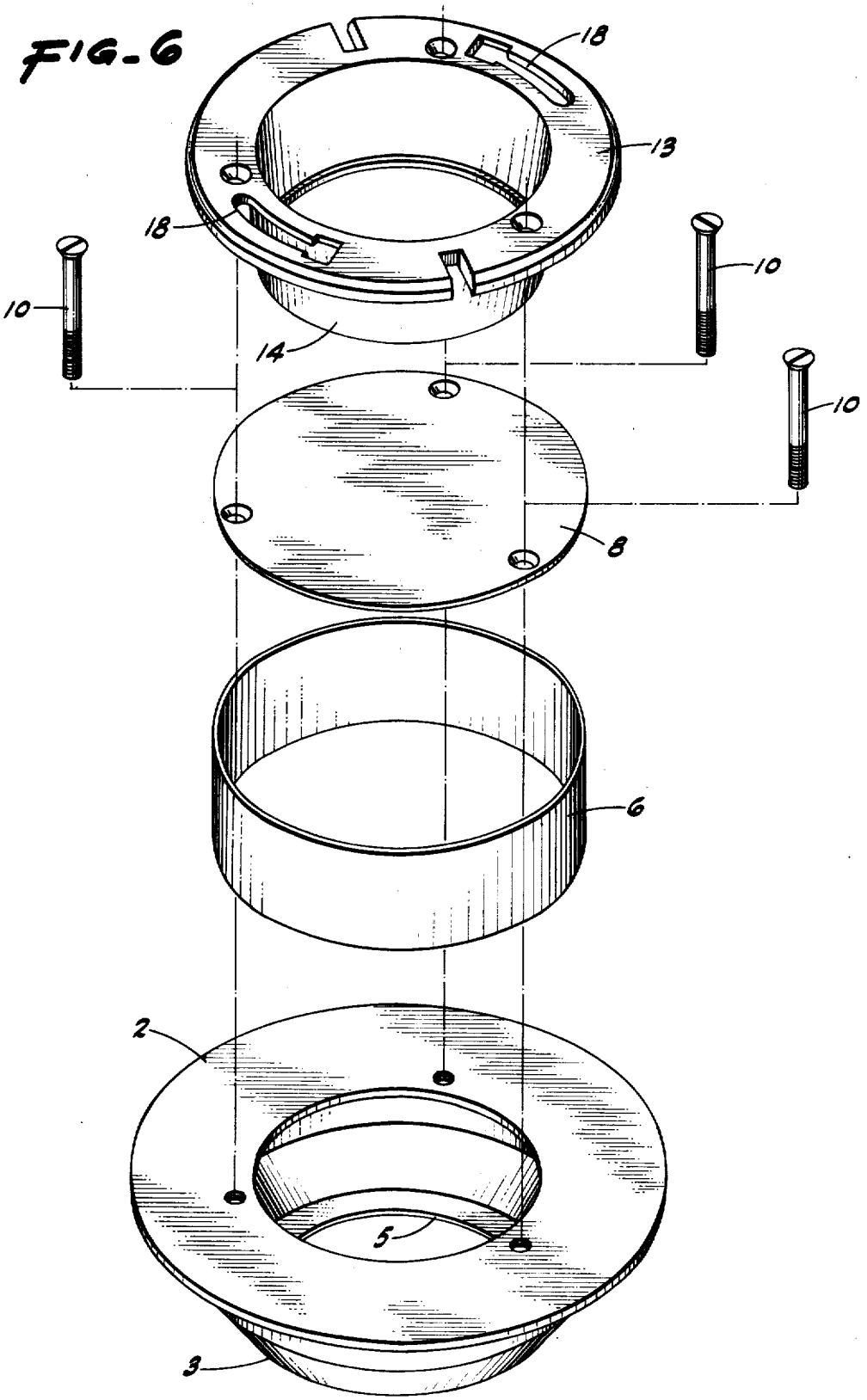
FIG. 6 is an exploded view of the parts, including the toilet attachment flange, which comprise the anchor unit.

Referring now more particularly to the drawings and to the characters of reference marked thereon, and particularly at present to FIGS. 1-3 and 6, the anchor unit is adapted for use with a sewer pipe riser 1 set before placement of the floor thereabout, and comprises the following:

A horizontal, annular sub-flange 2 surrounds the sewer pipe riser 1 a selected distance below the upper end of such riser, and which upper end is adjacent the plane of the surface of the floor to be later placed; the sub-flange 2 being positioned to lie beneath a portion of such floor.

The sub-flange 2 is fitted on the underside with a concentric, cup-like shroud 3 having an upper-edge wing 4 fixed to said sub-flange; the bottom of the shroud having a circular opening 5 of a diameter such that said shroud frictionally engages the riser 1 and firmly holds the sub-flange 2 in its selected position on said riser.

A cylindrical collar 6 rests on and upstands from the sub-flange 2; such collar 6 being concentric to, and of a diameter greater than, the riser 1 whereby an annular space exists between such parts. At its upper end, the collar 6 is engaged in a locating notch 7 in the periphery of a circular top plate 8 overlying, and projecting radially beyond, the riser 1 at the upper end of the latter; such top plate being formed on the underside with an annular locating rib 9 which depends in matching relation into the upper end of said riser.

A plurality of vertical, circumferentially spaced screws 10 extend through the radially projecting part of the top plate 8 and connect said top plate to the sub-flange 2; such screws extending—in protected relation—through the space between the riser 1 and collar 6. The lower end portions of the screws 10 which depend below the sub-flange 2 are within and protected by the shroud 3.

Upon the described parts being assembled in association with the riser 1 in the manner above described, the sub-flange 2 is effectively positioned against accidental displacement, especially in a downward direction. After the sub-flange 2 is so positioned, the floor 11 is placed (here shown in FIGS. 2 and 3 as poured concrete) with a portion thereof overlying said sub-flange and encompassing the collar 6. As usual, a bed 12 of small aggregate or sand underlies the concrete floor; the lower portion of the shroud 3 initially extending into such bed of aggregate to further support the sub-flange 2 preparatory to pouring of the concrete floor.

With the concrete floor 11 floor-poured as shown, the sub-flange is then permanently in place and cannot move upwardly on the riser 1. Thereafter, the screws 10 are removed, and the top plate 8 lifted away to expose the upper end of the riser 1. If desired, although not necessary, the collar 6 may also be removed.

Nextly, as shown in FIG. 3, a toilet attachment flange 13 (known as a floor flange) is placed on the floor 11 over and in concentric relation to the upper end of the riser 1, with the depending neck 14 of such flange 13 surrounding the upper part of said riser. The screws 10 are then employed to connect the toilet attachment flange 13 to the fixed-in-place sub-flange 2; the screws, when tightened, binding the flange 13 to floor 11. The flange 13 must, of course, have circumferentially spaced holes—for screw reception—the same as the top plate 8.

After the flange 13 is bound against the floor, the base 15 of a toilet bowl 16 is secured to said flange 13 by upstanding headed bolts 17 whose heads engage beneath bayonet slots 18 in said flange 13 in a generally conventional manner. Also, as conventional, a mastic sealing ring 19 is engaged between the base 15 and upper end of riser 1; there being a quantity of sealant 20 used, if desired, between neck 14 and the riser below the sealing ring 19.

With the attachment flange 2 floor-mounted as described, the toilet, as secured to such flange, is effectively maintained in a rigid position, and without any tendency of the flange to loosen on the floor with use of such toilet.

In FIGS. 4 and 5, the structural parts of the floor-mounted anchor unit remain the same and are identified by like reference numerals; these views of the drawings disclosing the anchor unit as employed with a wood floor, indicated generally at 21.

After the initial assembly of th sub-flange 2, collar 6, and top plate 8 on the riser 1, the wood floor 2 is then placed over such pre-positioned sub-flange. Then, just as before, the top-plate 8 is removed (along with collar 6 if desired), and the toilet attachment flange 13 is connected by screws 10 with the sub-flange 2; the screws being tightened until the toilet attachment flange 13 is tightly bound against the wood floor 21 and the sub-flange 2 drawn tight against the floor from beneath the same.

Thereafter, the toilet is mounted in connection with the attachment flange 13 is the same manner as shown in FIG. 3.

From the foregoing description, it will be readily seen that there has been produced such a floor-mounted anchor unit for toilets as substantially fulfills the objects of the invention, as set forth herein.

While this specification sets forth in detail the present and preferred construction of the floor-mounted anchor unit for toilets, still in practice such deviations from such detail may be resorted to as do not form a departure from the spirit of the invention as defined by the appended claims.

I claim:

1. In a floor-mounted anchor unit, for a toilet, which includes, in association with a floor, an annular, floor-supported, toilet attachment flange, there being a vertical sewer pipe riser disposed coaxially of the toilet attachment flange and extending upwardly therebelow, an annular, floor-engaging sub-flange concentrically surrounding the riser in spaced relation below the toilet attachment flange, and a plurality of vertical, circumferentially spaced screws connected in holding relation between the toilet attachment flange and sub-flange radially outwardly of the riser; the improvement characterized by the sub-flange including a cup-like shroud fixed on and depending from said sub-flange, and the shroud having a circular bottom opening through which the riser extends in matching frictional relation whereby the shroud positionally supports the sub-flange from the riser upon initial placement of such sub-flange on said riser, and the shroud being of a diameter such that said shroud encompasses, in protecting relation, lower end portions of the screws which project below the sub-flange.

2. In a floor-mounted anchor unit, as in claim 1, the further improvement characterized by the inclusion, in the unit after initial placement of the sub-flange and prior to connection of the screws between the toilet attachment flange and the sub-flange, of a removable collar upstanding from the sub-flange in spaced surrounding relation to the riser, and a removable top plate on the collar in closing relation to the upper end of said riser, the screws being connected between the top plate and sub-flange and extending in the space between the riser and said collar and protected by the latter.

* * * * *